US006109205A

United States Patent [19]

Smith

[11] Patent Number: 6,109,205

[45] Date of Patent: Aug. 29, 2000

[54] RESEARCH BOOKMARK

[76] Inventor: Brandon L. Smith, 51 Canonbie Road, Forest Hill, London SE23 3AQ, United Kingdom

[21] Appl. No.: 09/204,471

[22] Filed: Dec. 3, 1998

[51] Int. Cl.[7] ..... B42D 9/00

[52] U.S. Cl. ..... 116/234; 116/235; 281/42

[58] Field of Search ..... D19/34; 116/240, 116/234, 235, 236, 237, 238, 239; 40/360, 641, 674, 675; 283/36, 37, 38, 39, 40, 41, 42, 43, 115; 281/42; 402/79

[56] References Cited

U.S. PATENT DOCUMENTS

| | | | |
|---|---|---|---|
| 730,399 | 6/1903 | Rand | 40/384 |
| 916,561 | 3/1909 | Kahn | 40/374 |
| 1,043,049 | 10/1912 | Hermann | 40/360 |
| 1,048,577 | 12/1912 | Pardoe, Jr. | 40/359 |
| 1,461,710 | 7/1923 | Brinton | 283/115 |
| 2,034,413 | 3/1936 | Ottinger | 281/42 |
| 2,157,052 | 5/1939 | Brown | 40/360 |
| 2,652,059 | 9/1953 | Wassell | 40/360 |
| 4,448,310 | 5/1984 | Hodgson | 206/526 |
| 4,460,824 | 7/1984 | Kadogaki | 235/375 |
| 4,932,520 | 6/1990 | Ciarcia et al. | 206/232 |
| 5,387,011 | 2/1995 | Freund | 283/61 |

*Primary Examiner*—Andrew H. Hirshfeld
*Assistant Examiner*—R Alexander Smith

[57] ABSTRACT

A research bookmark for organizing and managing research references. The research bookmark includes a sheet with first and second horizontal lines extending between the side edges of the sheet and a vertical line extending between the second horizontal line and the bottom edge of the sheet. The first and second horizontal lines and the vertical line define a plurality of boxes on the front face of the sheet for writing information gathered from a book or magazine. The boxes include an index box, a topic box, a comments box, and a lines box. The comments box has a generally rectangular U-shaped separation line defining a page number tab therein.

9 Claims, 2 Drawing Sheets

RESEARCH BOOKMARK

BACKGROUND OF THE INVENTION

1. Field of the Invention

The present invention relates to research reference organizing and managing devices and more particularly pertains to a new research bookmark for organizing and managing research references.

2. Description of the Prior Art

The use of research reference organizing and managing devices is known in the prior art. More specifically, research reference organizing and managing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,287,823; 5,311,835; 4,970,984; 2,150,953; 2,300,216; and U.S. Pat. No. Des. 311,209.

While these devices fulfill their respective, particular objectives and requirements, the aforementioned patents do not disclose a new research bookmark. The inventive device includes a sheet with first and second horizontal lines extending between the side edges of the sheet and a vertical line extending between the second horizontal line and the bottom edge of the sheet. The first and second horizontal lines and the vertical line define a plurality of boxes on the front face of the sheet for writing information gathered from a book or magazine. The boxes include an index box, a topic box, a comments box, and a lines box. The comments box has a generally rectangular U-shaped separation line defining a page number tab therein.

In these respects, the research bookmark according to the present invention substantially departs from the conventional concepts and designs of the prior art, and in so doing provides an apparatus primarily developed for the purpose of organizing and managing research references.

SUMMARY OF THE INVENTION

In view of the foregoing disadvantages inherent in the known types of research reference organizing and managing devices now present in the prior art, the present invention provides a new research bookmark construction wherein the same can be utilized for organizing and managing research references.

The general purpose of the present invention, which will be described subsequently in greater detail, is to provide a new research bookmark apparatus and method which has many of the advantages of the research reference organizing and managing devices mentioned heretofore and many novel features that result in a new research bookmark which is not anticipated, rendered obvious, suggested, or even implied by any of the prior art research reference organizing and managing devices, either alone or in any combination thereof.

To attain this, the present invention generally comprises a sheet with first and second horizontal lines extending between the side edges of the sheet and a vertical line extending between the second horizontal line and the bottom edge of the sheet. The first and second horizontal lines and the vertical line define a plurality of boxes on the front face of the sheet for writing information gathered from a book or magazine. The boxes include an index box, a topic box, a comments box, and a lines box. The comments box has a generally rectangular U-shaped separation line defining a page number tab therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new research bookmark apparatus and method which has many of the advantages of the research reference organizing and managing devices mentioned heretofore and many novel features that result in a new research bookmark which is not anticipated, rendered obvious, suggested, or even implied by any of the prior art research reference organizing and managing devices, either alone or in any combination thereof.

It is another object of the present invention to provide a new research bookmark which may be easily and efficiently manufactured and marketed.

It is a further object of the present invention to provide a new research bookmark which is of a durable and reliable construction.

An even further object of the present invention is to provide a new research bookmark which is susceptible of a low cost of manufacture with regard to both materials and labor, and which accordingly is then susceptible of low prices of sale to the consuming public, thereby making such research bookmark economically available to the buying public.

Still yet another object of the present invention is to provide a new research bookmark which provides in the apparatuses and methods of the prior art some of the advantages thereof, while simultaneously overcoming some of the disadvantages normally associated therewith.

Still another object of the present invention is to provide a new research bookmark for organizing and managing research references.

Yet another object of the present invention is to provide a new research bookmark which includes a sheet with first and second horizontal lines extending between the side edges of the sheet and a vertical line extending between the second horizontal line and the bottom edge of the sheet. The first and second horizontal lines and the vertical line define a plurality of boxes on the front face of the sheet for writing information gathered from a book or magazine. The boxes include an index box, a topic box, a comments box, and a lines box. The comments box has a generally rectangular U-shaped separation line defining a page number tab therein.

Still yet another object of the present invention is to provide a new research bookmark that lets a user organize information gathered from books and magazines to be organized and indexed to form a summary framework for future consideration, such as creating a report on the gathered information.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
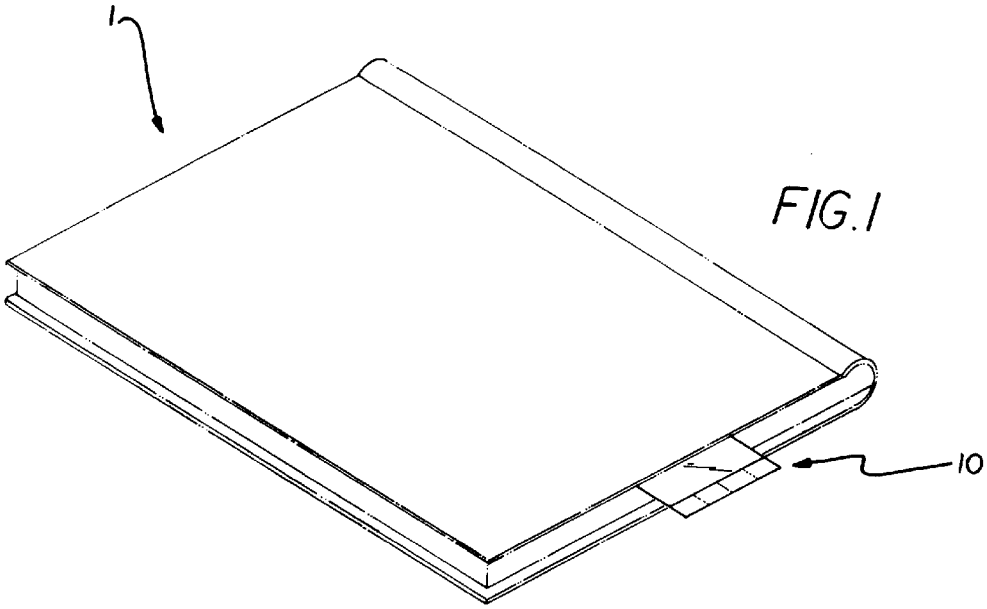
FIG. 1 is a schematic perspective view of a new research bookmark in use marking the location of a page in a book according to the present invention.
Figure 2:
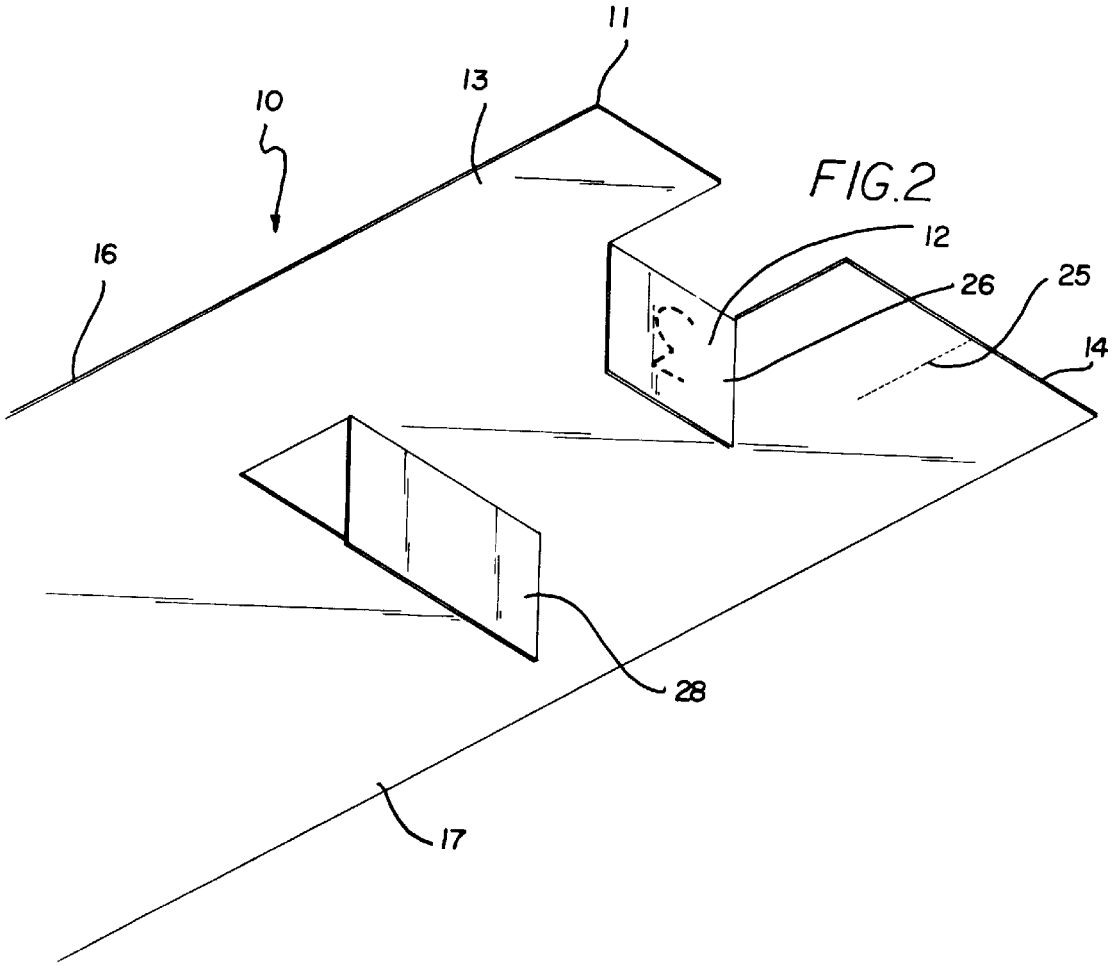
FIG. 2 is a schematic perspective view of the back face of the sheet of the present invention with the page number tab and an index tab folded back.
Figure 3:
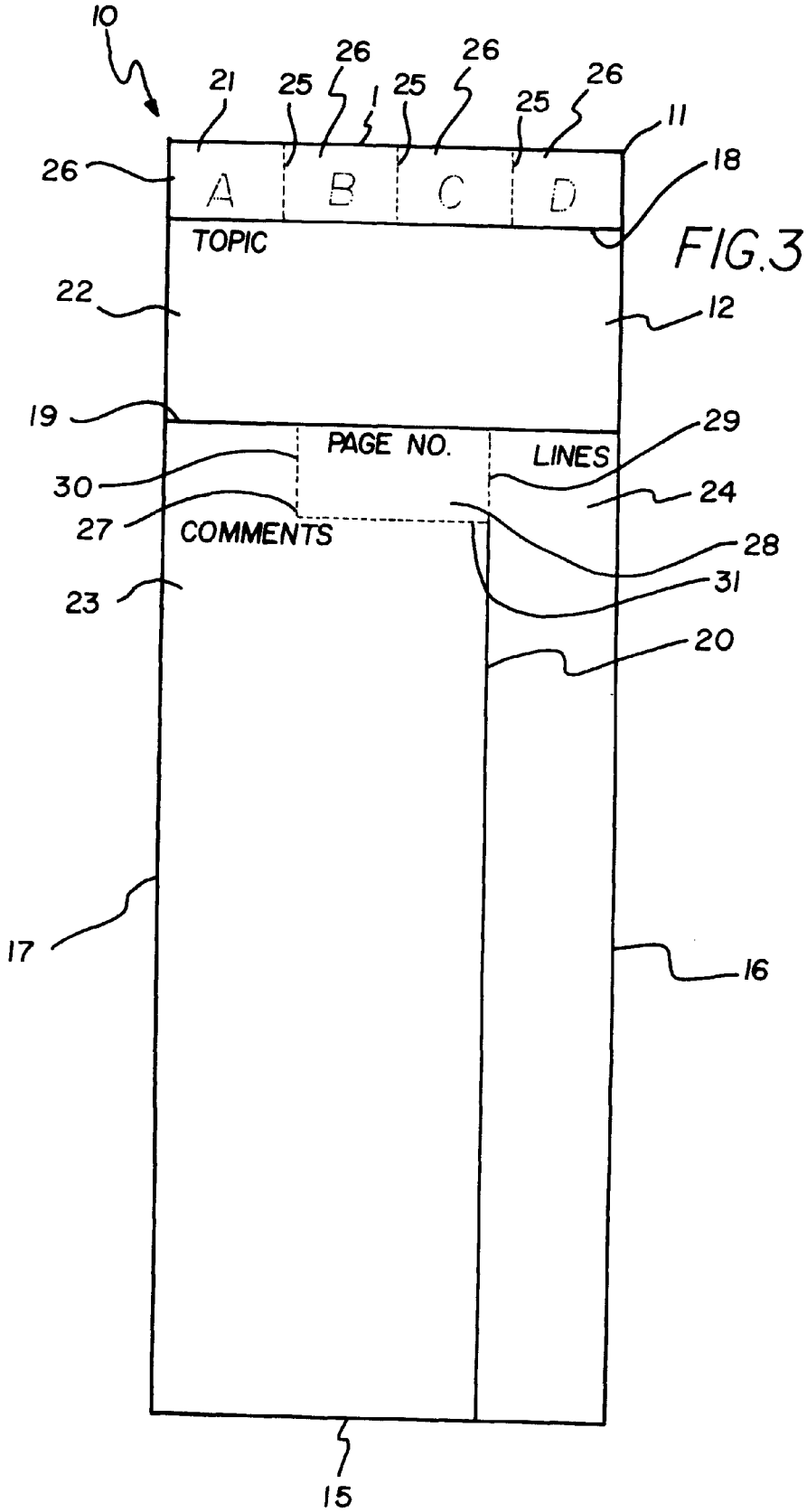
FIG. 3 is a schematic front side view of the front face of the sheet of the present invention.

With reference now to the drawings, and in particular to FIGS. 1 through 3 thereof, a new research bookmark embodying the principles and concepts of the present invention and generally designated by the reference numeral 10 will be described.

As best illustrated in FIGS. 1 through 3, the research bookmark 10 generally comprises a sheet 11 with first and second horizontal lines 18,19 extending between the side edges 16,17 of the sheet 11 and a vertical line 20 extending between the second horizontal line 19 and the bottom edge 15 of the sheet 11. The first and second horizontal lines 18,19 and the vertical line 20 define a plurality of boxes on the front face 12 of the sheet 11 for writing information gathered from a book or magazine. The boxes include an index box 21, a topic box 22, a comments box 23, and a lines box 24. The comments box 23 has a generally rectangular U-shaped separation line 27 defining a page number tab 28 therein.

In closer detail, the bookmark 10 comprises a generally rectangular sheet 11 with substantially flat front and back faces 12,13, generally straight top and bottom edges 14,15, and a pair of generally straight side edges 16,17 extending between the top and bottom edges 14,15 of the sheet 11. The top and bottom edges 14,15 of the sheet 11 are extended generally parallel to one another. The side edges 16,17 of the sheet 11 are extended generally parallel to one another and generally perpendicular to the top and bottom edges 14,15 of the sheet 11. The sheet 11 has a length defined between the top and bottom edges 14,15 of the sheet 11 and a width defined between the side edges 16,17 of the sheet 11. In an ideal illustrative embodiment, the width of the sheet 11 is about 6 cm. The length of the sheet 11 may ideally come in three different lengths of about 24 cm, about 28 cm, and about 34 cm to fit various sized books and magazines 1.

As illustrated in FIG. 1, the front face 12 of the sheet 11 has generally parallel first and second horizontal lines 18,19 extending between the side edges 16,17 of the sheet 11. The first and second horizontal lines 18,19 are spaced apart from one another. The first and second horizontal lines 18,19 are extended generally parallel to the top and bottom edges 14,15 of the sheet 11. The first horizontal line 18 is positioned towards the top edge 14 of the sheet 11. The second horizontal line 19 is positioned between the first horizontal line 18 and the bottom edge 15 of the sheet 11. The second horizontal line 19 is preferably positioned closer to the top edge 14 of the sheet 11 than the bottom edge 15 of the sheet 11. Ideally, the first horizontal line 18 is spaced apart from the top edge 14 of the sheet 11 about 1 cm, and the second horizontal line 19 is spaced apart from the first horizontal line 18 about 3 cm.

The front face 12 of the sheet 11 also has a vertical line 20 extending between the second horizontal line 19 and the bottom edge 15 of the sheet 11. The vertical line 20 is extended generally parallel to the side edges 16,17 of the sheet 11 and generally perpendicular to the first and second horizontal lines 18,19. The vertical line 20 is spaced apart from the side edges 16,17 of the sheet 11. The vertical line 20 is preferably positioned closer to one of the side edges 16 of the sheet 11 than to the other side edge 17 of the sheet 11. Ideally, the vertical line 20 is spaced apart from the one side edge 16 about 1.5 cm.

The first and second horizontal lines 18,19 and the vertical line 20 define a plurality of boxes on the front face 12 of the sheet 11 designed for writing information of a book or magazine 1 thereon. The boxes include an index box 21, a topic box 22, a comments box 23, and a lines box 24. The index box 21 is defined between the top edge 14 of the sheet 11 and the first horizontal line 18. The topic box 22 is defined between the first and second horizontal lines 18,19. The lines box 24 is defined between the second horizontal line 19 and the bottom edge 15 of the sheet 11 and between the vertical line 20 and the one side edge 16 of the sheet 11. The comments box 23 is defined between the second horizontal line 19 and the bottom edge 15 of the sheet 11 and between the vertical line 20 and the other side edge 17 of the sheet 11.

The index box 21 has a plurality of generally parallel separation lines 25 extending between first horizontal line 18 and the top edge 14 of the sheet 11. The separation lines 25 of the index box 21 are spaced apart at generally equal intervals between the side edges 16,17 of the sheet 11. The separation lines 25 and the side edges 16,17 of the sheet 11 define index tabs 26 therebetween. Preferably, each of the separation lines of the index box 21 has a plurality of apertures through the front and back faces 12,13 of the sheet 11 designed for aiding separation of adjacent index tabs 26 one another. Ideally, the apertures of the separation lines of the index box 21 comprise perforations. In use, each of the index tabs 26 is foldable along the first horizontal line 18 such that each separated index tab may by outwardly extended from the front and back faces 12,13 of the sheet 11 as illustrated in FIG. 2.

Ideally, the topic box 22 has the indicia "TOPIC" displayed therein on the front face 12 of the sheet 11 adjacent the first horizontal line 18. The lines box 24 has the indicia "LINES" displayed therein on the front face 12 of the sheet 11 adjacent the second horizontal line 19. The comments box 23 has the indicia "COMMENTS" displayed therein on the front face 12 of the sheet 11.

The comments box 23 has a generally rectangular U-shaped separation line 27 defining a page number tab 28 therein. The U-shaped separation line 27 has a spaced apart pair of generally parallel side portions 29,30 and a cross portion 31 connecting the side portions 29,30 together. The side portions 29,30 of the U-shaped separation line 27 are extended generally parallel to the side edges 16,17 of the sheet 11. The cross portion 31 of the U-shaped separation line 27 is extended generally parallel to the second horizontal line 19. The side portions 29,30 of the U-shaped separation line 27 are positioned adjacent the second horizontal line 19 with one of the side portions 29,30 of the U-shaped separation line 27 positioned along the vertical line 20. In an ideal illustrative embodiment, the side portions 29,30 of the U-shaped separation line 27 are spaced apart about 3 cm from one another and therefore about 1.5 cm from the nearest adjacent side edge of the sheet 11. In this ideal embodiment, the cross portion 31 of the U-shaped separation line 27 is spaced apart from the second horizontal line 19 about 1.5 cm. The U-shaped separation line 27 also preferably has a plurality of apertures through the front and back faces 12,13 of the sheet 11 designed for aiding separation of the page number tab 28 from the sheet 11 along the U-shaped separation line 27. Ideally, the apertures of the U-shaped separation line 27 comprise perforations. In use, the page number tab 28 is foldable along the second horizontal line 19 such that the page number tab 28 may by outwardly extended from the front and back faces 12,13 of the sheet 11.

In use, the bookmark 10 is placed on top of the desired page of the book or magazine that the user wants to collect information from. The user then writes down the desired information in the comments box and the line number of the information in the lines box. The related page number may then written on the page number tab which is then separated along the U-shaped separation line so that it may be folded back along the second horizontal line so that the page number tab may be hooked over the back of the related page of the book. This keeps the bookmark in place on the desired page. The user may then place outline organization indicia on one of the index tabs which extend outwardly from the book as illustrated in FIG. 1 so that the user can easily read the writing on the index tabs. Optionally, the user may even color code the index tabs for providing quick visual organizing indicia.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bookmark, comprising:

a sheet having front and back faces, top and bottom edges, and a pair of side edges extending between said top and bottom edges of said sheet;

said front face of said sheet having printed first and second horizontal lines extending between said side edges of said sheet, said first and second horizontal lines being spaced apart from one another;

said first horizontal line being positioned towards said top edge of said sheet;

said second horizontal line being positioned between said first horizontal line and said bottom edge of said sheet;

said front face of said sheet having a printed vertical line extending between said second horizontal line and said bottom edge of said sheet;

said vertical line being spaced apart from said side edges of said sheet;

said first and second horizontal lines and said vertical line defining a plurality of boxes on said front face of said sheet;

said boxes including an index box, a topic box, a comments box, and a lines box;

said index box being defined between said top edge of said sheet and said first horizontal line;

said topic box being defined between said first and second horizontal lines;

said lines box being defined between said second horizontal line and said bottom edge of said sheet and between said vertical line and one of said side edges of said sheet;

said comments box being defined between said second horizontal line and said bottom edge of said sheet and between said vertical line and the other side edge of said sheet;

said index box having a plurality of generally parallel separation lines having a plurality of apertures and extending between said first horizontal line and said top edge of said sheet;

said separation lines and said side edges of said sheet defining index tabs therebetween; and said comments box having a generally rectangular U-shaped separation line having a plurality of apertures and defining a page number tab therein, said U-shaped separation line having a spaced apart pair of generally parallel side portions and a cross portion connecting said side portions together.

2. The bookmark of claim 1, wherein said top and bottom edges of said sheet are extended generally parallel to one another, said side edges of said sheet are extended generally parallel to one another and generally perpendicular to said top and bottom edges of said sheet.

3. The bookmark of claim 1, wherein said second horizontal line is positioned closer to said top edge of said sheet than said bottom edge of said sheet.

4. The bookmark of claim 1, wherein said vertical line is positioned closer to said one side edge of said sheet than to the other side edge of said sheet.

5. The bookmark of claim 1, wherein said separation lines of said index box are spaced apart at generally equal intervals between said side edges of said sheet.

6. The bookmark of claim 1, wherein said apertures of said separation lines of said index box and said comment box comprise perforations.

7. The bookmark of claim 1, wherein said topic box has the indicia "TOPIC" displayed therein on the front face of said sheet adjacent said first horizontal line, wherein said lines box has the indicia "LINES" displayed therein on the front face of said sheet adjacent said second horizontal line, and wherein said comments box has the indicia "COMMENTS" displayed therein on said front face of said sheet.

8. The bookmark of claim 1, wherein said side portions of said U-shaped separation line are extended generally parallel to said side edges of said sheet, said cross portion of said U-shaped separation line is extended generally parallel to said second horizontal line, and one of said side portions of said U-shaped separation line is positioned along said vertical line.

9. A bookmark, comprising:

a generally rectangular sheet having substantially flat front and back faces, generally straight top and bottom edges, and a pair of generally straight side edges extending between said top and bottom edges of said sheet;

said top and bottom edges of said sheet being extended generally parallel to one another, said side edges of said sheet being extended generally parallel to one another and generally perpendicular to said top and bottom edges of said sheet;

said front face of said sheet having generally parallel printed first and second horizontal lines extending between said side edges of said sheet, said first and second horizontal lines being spaced apart from one another;

said first and second horizontal lines being extended generally parallel to said top and bottom edges of said sheet;

said first horizontal line being positioned towards said top edge of said sheet;

said second horizontal line being positioned between said first horizontal line and said bottom edge of said sheet, said second horizontal line being positioned closer to said top edge of said sheet than said bottom edge of said sheet;

wherein said first horizontal line is spaced apart from said top edge of said sheet about 1 cm, wherein said second horizontal line is spaced apart from said first horizontal line about 3 cm;

said front face of said sheet having a printed vertical line extending between said second horizontal line and said bottom edge of said sheet, said vertical line being extended generally parallel to said side edges of said sheet and generally perpendicular to said first and second horizontal lines;

said vertical line being spaced apart from said side edges of said sheet, said vertical line being positioned closer to one of said side edges of said sheet than to the other side edge of said sheet, wherein said vertical line is spaced apart from said one side edge about 1.5 cm;

said first and second horizontal lines and said vertical line defining a plurality of boxes on said front face of said sheet;

said boxes including an index box, a topic box, a comments box, and a lines box;

said index box being defined between said top edge of said sheet and said first horizontal line;

said topic box being defined between said first and second horizontal lines;

said lines box being defined between said second horizontal line and said bottom edge of said sheet and between said vertical line and said one side edge of said sheet;

said comments box being defined between said second horizontal line and said bottom edge of said sheet and between said vertical line and said other side edge of said sheet;

said index box having a plurality of generally parallel separation lines having a plurality of apertures and extending between first horizontal line and said top edge of said sheet;

said separation lines of said index box being spaced apart at generally equal intervals between said side edges of said sheet;

said separation lines and said side edges of said sheet defining index tabs therebetween;

each of said separation lines of said index box having a plurality of apertures through said front and back faces of said sheet adapted for aiding separation of adjacent index tabs, wherein said apertures of said separation lines of said index box comprise perforations;

said topic box having the indicia "TOPIC" displayed therein on the front face of said sheet adjacent said first horizontal line;

said lines box having the indicia "LINES" displayed therein on the front face of said sheet adjacent said second horizontal line;

said comments box having the indicia "COMMENTS" displayed therein on said front face of said sheet;

said comments box having a generally rectangular U-shaped separation line having a plurality of apertures and defining a page number tab therein, said U-shaped separation line having a spaced apart pair of generally parallel side portions and a cross portion connecting said side portions together;

said side portions of said U-shaped separation line being extended generally parallel to said side edges of said sheet, said cross portion of said U-shaped separation line being extended generally parallel to said second horizontal line;

said side portions of said U-shaped separation line being positioned adjacent said second horizontal line, one of said side portions of said U-shaped separation line being positioned along said vertical line;

wherein said side portions of said U-shaped separation line are spaced apart about 3 cm from one another, wherein said cross portion of said U-shaped separation line is spaced apart from said second horizontal line about 1.5 cm; and said U-shaped separation line having said plurality of apertures through said front and back faces of said sheet adapted for aiding separation of said page number tab from said sheet along said U-shaped separation line, wherein said apertures of said U-shaped separation line comprise perforations.

* * * * *